US006059468A

United States Patent [19]

Haug

[11] Patent Number: 6,059,468

[45] Date of Patent: May 9, 2000

[54] PRINTING MECHANISM WITH MECHANISM FOR ADJUSTING TO THE THICKNESS OF THE PRINT MEDIUM

[76] Inventor: Werner Haug, Oberstrasse 12, CH-3550 Langnau im Emmental, Switzerland

[21] Appl. No.: 09/180,643

[22] PCT Filed: Feb. 24, 1998

[86] PCT No.: PCT/CH98/00074

§ 371 Date: Jan. 11, 1999

§ 102(e) Date: Jan. 11, 1999

[87] PCT Pub. No.: WO98/40220

PCT Pub. Date: Sep. 17, 1998

[30] Foreign Application Priority Data

Mar. 11, 1997 [CH] Switzerland ..... 566/97

[51] Int. Cl.[7] ..... B41J 11/20

[52] U.S. Cl. ..... 400/56; 400/120.16; 347/197

[58] Field of Search ..... 400/55, 57, 56, 400/58, 120.16, 120.17, 59; 101/93; 347/198, 197

[56] References Cited

U.S. PATENT DOCUMENTS

| | | | |
|---|---|---|---|
| 4,179,989 | 12/1979 | Sato | 101/291 |
| 5,036,338 | 7/1991 | Imai | 400/120.16 |
| 5,118,208 | 6/1992 | Kitahara et al. | 400/56 |
| 5,176,459 | 1/1993 | Bessho et al. | 400/160 |
| 5,547,293 | 8/1996 | Koch et al. | 400/120.17 |

FOREIGN PATENT DOCUMENTS

| | | | |
|---|---|---|---|
| 61-199969 | 9/1986 | Japan | 400/56 |
| 8703251 | 6/1987 | WIPO . | |

OTHER PUBLICATIONS

Patent Abstracts of Japan, vol. 012, No. 448 (M–768), Nov. 24, 1988 & JP 63 178056 A (Matsushita Electric Ind Co Ltd), Jul. 22, 1988.

Patent Abstracts of Japan, vol. 018, No. 083 (M–1558), Feb. 10, 1994 & JP 05 293950 A (Mitani Denshi Kogyo KK), Nov. 9, 1993.

Patent Abstracts of Japan, vol. 014, No. 140 (M–0950), Mar. 16, 1990 & JP 02 006169 A (NEC Data Terminal Ltd), Jan. 10, 1990.

*Primary Examiner*—Christopher A. Bennett
*Attorney, Agent, or Firm*—Friedrich Kueffner

[57] ABSTRACT

A thermal printing mechanism has a printer head for printing on a flat object transported in a transport direction through the thermal printing mechanism. A roll lever is pivotable about a pivot axis at its first end. A counterpressure roll is mounted to the second end of the roll lever and supports the flat object for printing by the printer head. A freely rotatable roll is positioned in the vicinity of the printer head and mounted in a fixed position relative to the pivot axis. A mechanism for adjusting a position of the counterpressure roll at the freely rotatable roll in accordance with a thickness of the flat object passing between the counterpressure roll and the freely rotatable roll is provided and the print head thus always applies the same pressure onto the object to be printed.

9 Claims, 3 Drawing Sheets

PRINTING MECHANISM WITH MECHANISM FOR ADJUSTING TO THE THICKNESS OF THE PRINT MEDIUM

BACKGROUND OF THE INVENTION

1. Field of the Invention

The present invention comprises a printing mechanism with a print head, especially for incorporation into machines which are suitable for applying printed images to objects of different dimensions.

2. Description of the Related Art

Printing mechanisms which produce an imprint on an object by means of a stamper have been known for a long time. Printing mechanisms of this type served especially to produce postage stamps on envelopes, postcards, and similar postal items. As printing technology advanced, and especially with the arrival of thermal transfer printing technology, the demand increased for transferring the advantages of this so-called thermal printing process to the printing of postage stamps.

SUMMARY OF THE INVENTION

The task was therefore to design a printing mechanism with a print head, e.g., a thermal print head, which contacts the surface of the object to be printed, which mechanism can either be retrofitted into machines already on hand with, for example, an ink pad printing mechanism, or used in the design of a completely new machine equipped with a printer. In the latter case, it is conceivable that it will be possible for certain parts of the printing mechanism, e.g., the printing mechanism housing, to be integrated into the machine (e.g., a postage machine) which holds the printing mechanism. It is also to be understood as a condition of this task, of course, that the new printing mechanism will be able to print on objects of different geometric dimensions, which is to say, letters of different thicknesses, with equal or better results than those obtained with the previously known printing mechanisms based on the known printing technology.

This task is accomplished by the print head which produces the imprint being mounted in such a way on a lever that, when in the printing position, it acts with a constant applied force on an object situated between it and a counterpressure roll, regardless of the distance which separates it from the counterpressure roller, which is also supported by a lever, and by the printing mechanism having a main shaft, on which two cams are mounted, each of which acts positively on a lever. A postage machine which contains the printing mechanism designed in accordance with the invention is also a component of the invention.

The print head and the counterpressure roll are each mounted on levers which are free to pivot and each of which has its own force-exerting element. The two levers have a common center of rotation. The lever carrying the counterpressure roll is connected to another lever by way of the force-exerting element, which can be designed e.g. as a spring. The additional lever is pulled by the other force-exerting element, which can also be designed e.g. as a spring, against a stop on the lever carrying the counterpressure roll, this stop thus acting to limit the counterpressure. A stationary roll, with respect to the printing mechanism housing, serves as a fixed stop for the object and/or limits the distance over which the counterpressure roll can pivot. A transport motor is positively connected by way of force-transmitting means to the counterpressure roll. It has means for detecting the rotational angle of at least one of the rolls and/or the instantaneous position of the object to be printed in the area of the print head. A control unit is present which, at beginning of the printing process, turns the main shaft by a part of a complete revolution, preferably by about 120°. The transport motor is then turned on, and a position sensor in the form of, for example, a photo cell, allows the main shaft to rotate again after the sensor has detected the object to be printed.

The invention offers the advantage that, with little technical effort and in an extremely reliable way, the print head can be set down on objects of different thicknesses (ranging from nearly 0 to, for example, several centimeters or more) and the imprint transferred by means of the transfer ribbon under an applied pressure which will always be the same. By means of the features of the dependent claims, either the complexity of the design can be reduced and/or the degree of automation of the printing mechanism can be increased.

BRIEF DESCRIPTION OF THE DRAWING

A printing mechanism according to the invention integrated into a postage machine is explained in greater detail below by way of example on the basis of the attached figures.

DESCRIPTION OF THE PREFERRED EMBODIMENTS

Figure 1:
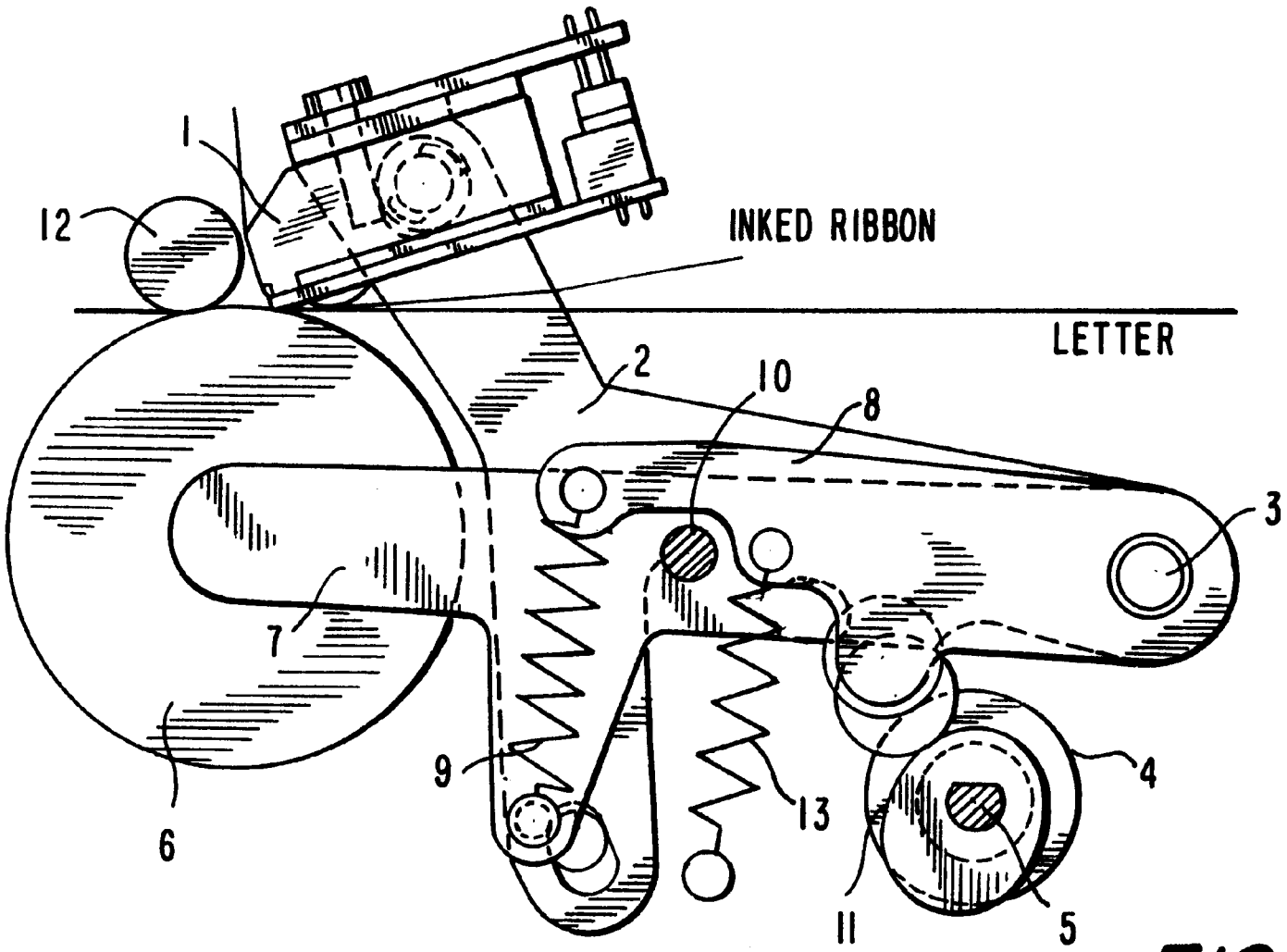
FIG. 1 shows a side view of a printing mechanism.

Thermal print head 1 (a standard commercial component) is, according to FIG. 1, mounted on a lever 2, which can pivot around center of rotation 3. This lever is positively controlled by way of a cam 4, mounted on a driven main shaft 5. In the waiting (normal) position, lever 2 is raised; that is, the print head leaves room for an envelope to be inserted.

After the main shaft has rotated by an angle of about 120°, lever 2 is swung down by way of spring 13 to such an extent that print head 1, together with the inked ribbon which is pulled along underneath it, rests on the envelope. The bottom surface of the envelope is resting at this point on counterpressure roll 6.

Counterpressure roll 6 is supported rotatably on and between two levers 7, which can pivot around the same center of rotation as lever 2. Each of these roll levers 7 is coupled by a spring 9 to another auxiliary lever 8, which is also able to pivot around the same center point 3. Spring 9 can pull lever 8 back only as far as a stop 10 on roll lever 7; this stop thus has the effect of limiting the counterpressure. Levers 8 are for their part positively controlled in each case by a second cam 11, also mounted on main shaft 5. Levers 8 are in this way pushed upward by cam 11, whereas levers 7 supporting counterpressure roll 6 move upward only to such an extent that counterpressure roll 6, together with the envelope resting on it, comes to rest against the stationary roll 12. The overstroke of lever 8 with respect to lever 7 which thus occurs brings about a pretensioning of spring 9. Because the elastic force exerted by spring 9 must be greater than the elastic force exerted by spring 13 via lever 2 and the print head 1 on roll lever 7, print head 1 is pressed by a constant differential force onto the inked ribbon (and thus onto the envelope), the force being essentially independent of the thickness of the envelope. In other words: The force applied by the print head can be determined through the choice of springs 9, 13.

This principle and the free oscillation of the counterpressure roll around axis 3 make it possible for the surface of the envelope to be printed to be kept parallel even when the thickness dimensions of the envelope have local variations. In other words: envelopes filled irregularly can be easily and reproducibly printed thanks to the constant applied pressure and the ability of the print head to move freely around the pivot axis.

The choice of the strength of the springs depends primarily on the weight of the standard commercial print head selected in the specific case and on the amount of force which the print head is required to apply. In addition, the dependence of the effect of the force on distance can also be optimized by way of the characteristic of the spring.

Of course, the use of vibration dampers in parallel with the springs is also conceivable.

Figure 2:
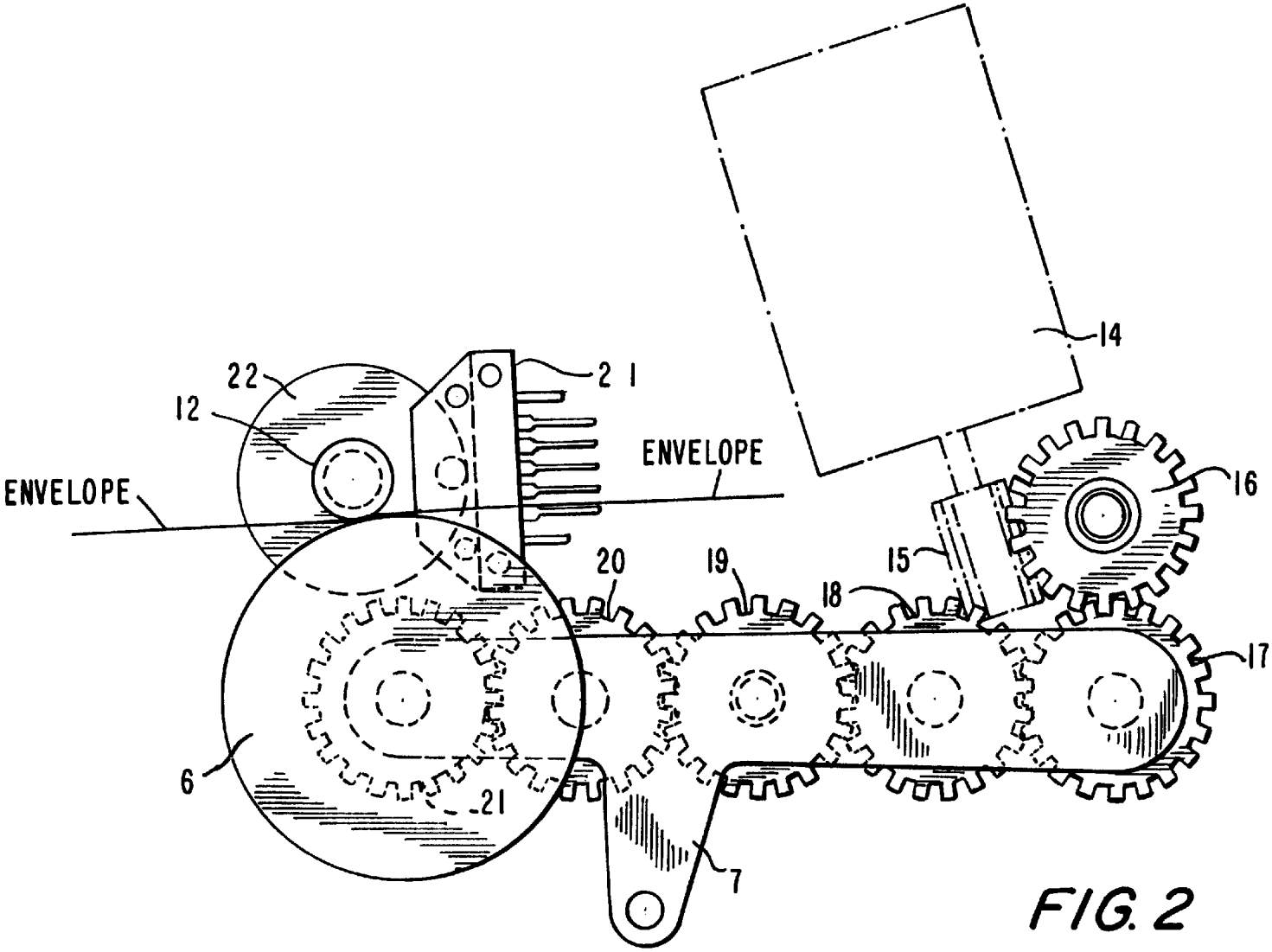
FIG. 2 shows the drive mechanism of the counterpressure roll.

FIG. 2 now shows how the envelope is fed through the machine by counterpressure roll 6. A motor 14, mounted permanently in the housing of the printing mechanism, uses a worm gear pair 15, 16 to drive a series of gears 17–21, which are supported on one of the roll levers 7. The last gear 21 is seated on the same shaft as counterpressure roll 6 and drives it independently of the roll's position. Because roll 6 for its part is pressed from below against the envelope under the differential pretension of the spring described above, the envelope is positively transported by rotating roll 6. As a result, however, stationary roll 12 situated on the other side of the envelope also rotates. By way of rotational angle-signaling systems in the form of, for example, slotted disks, standard commercial position sensors 22, and light barriers of an electronic circuit (not described in detail here, because this is realizable in many different ways), the current position of the envelope is detected and transmitted. This electronic circuit can then initiate the printing by print head 1 at a selectable distance from the edge of the envelope.

Figure 3:
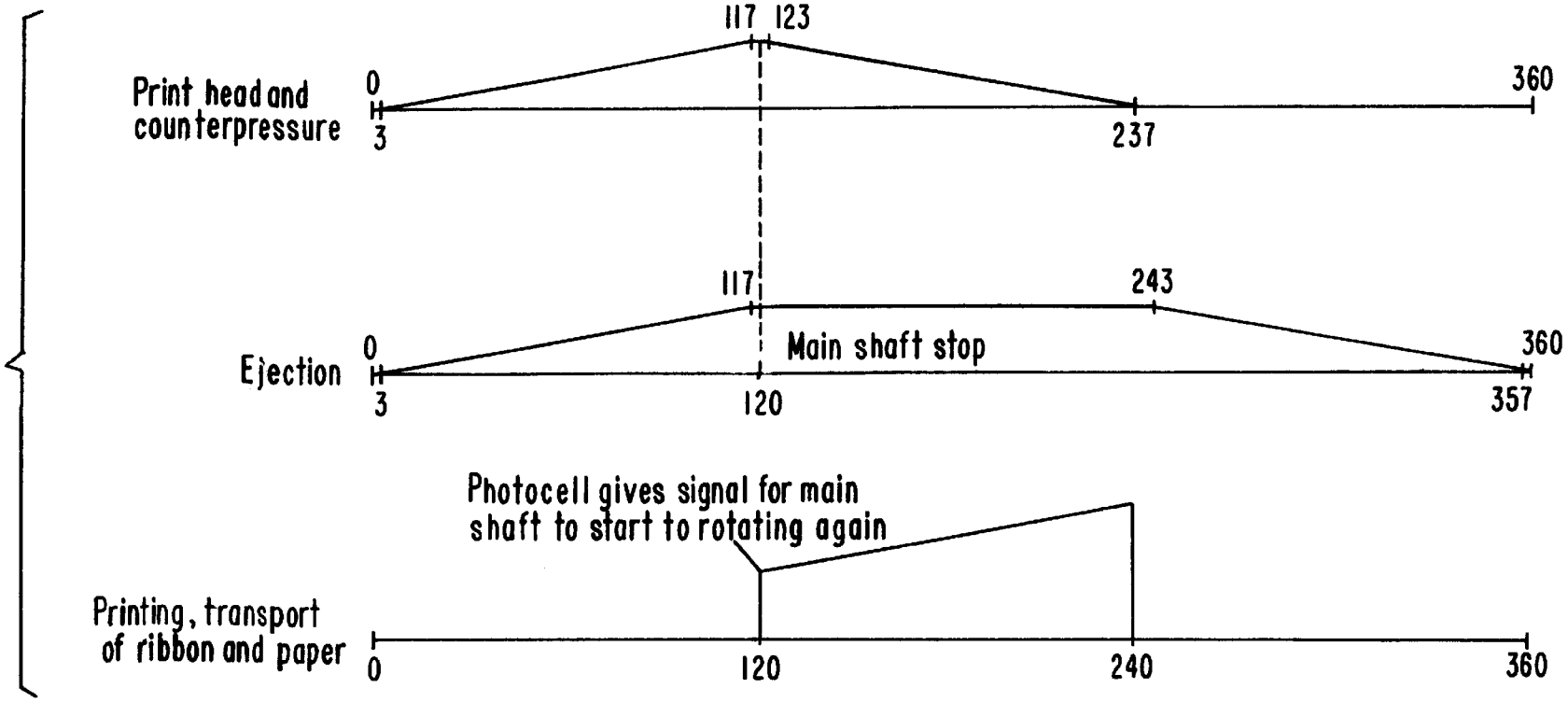
FIG. 3 shows a diagram of the movement of the main shaft over time.

In the form of a time diagram, FIG. 3 shows the printing process for an individual envelope. The first 120° of rotation of main shaft 5 are responsible for introducing and clamping the envelope between counterpressure roll 6 and stationary roll 12 and for lowering print head 1. At this point, the rotation of main shaft 5 is stopped, and transport motor 14 is started. Thus the envelope is transported along underneath the print head and printed until a light barrier (not shown) starts main shaft 5 again. The print head and counterpressure roll 6 are then moved away from the surface of the envelope. The envelope continues to travel, however. For this purpose, a pair of ejector rolls (not shown) takes care of the remaining distance to be covered and then ejects the envelope out of the area of the printing mechanism. At 240° of main shaft rotation, the pair of ejector rolls is also opened, and the transport drive is turned off.

The invention is not limited to the design described here and illustrated in the figures. On the contrary, it comprises any printing mechanism in which the principle of the claims is realized, that is, any mechanism which makes it possible primarily for a print head to be pressed at a constant force which is independent of the thickness of the object. It is irrelevant if the individual elements illustrated here are replaced by others which work in the same or similar manner or which have the same effect.

The option is reserved to supplement the claims with parts of the specification/drawings. In particular, it is conceivable that known machines still in use can be retrofitted with printing mechanisms according to the invention. The right is reserved to add any claims pertaining to the correspond retrofitting processes. In addition, any machines which print envelope-like bags or containers in the manner described, especially items with dimensions which vary with their content, also fall within the scope of the protection.

I claim:

1. A thermal printing mechanism for printing on a flat object, the thermal printing mechanism comprising:

a printer head configured to print on a flat object transported in a transport direction through the thermal printing mechanism;

a roll lever having a first end and a second end and configured to pivot about a pivot axis at the first end;

a counterpressure roll mounted to the second end of the roll lever and configured to support the flat object for printing by the printer head;

a freely rotatable roll positioned in the vicinity of the printer head and mounted in a fixed position relative to the pivot axis;

a mechanism configured to adjust a position of the counterpressure roll at the freely rotatable roll in accordance with a thickness of the flat object passing between the counterpressure roll and the freely rotatable roll.

2. The thermal printing mechanism according to claim 1, wherein the control mechanism comprises a main shaft and a cam mounted on the main shaft, wherein the cam is configured to act adjustably on the roll lever.

3. The thermal printing mechanism according to claim 1, further comprising an auxiliary lever having a first end configured to pivot about the pivot axis of the first end of the roll lever, and further comprising a pretensioned spring connected to the roll lever and the auxiliary lever.

4. The thermal printing mechanism according to claim 3, wherein the roll lever has a stop and wherein the pretensioned spring is configured to force the auxiliary lever against the stop.

5. The thermal printing mechanism according to claim 4, wherein the cam is configured to control the roll lever via the auxiliary lever.

6. The thermal printing mechanism according to claim 1, comprising a drive motor and a series of gears, the series of gears mounted on the roll lever and configured to connect the drive motor to the counterpressure roll.

7. The thermal printing mechanism according to claim 2, further comprising:

a printer head lever having a first end and a second end, wherein the first end of the printer head lever is configured to pivot about the pivot axis of the first end of the roll lever, wherein the printer head is mounted on the second end of the printer head lever; and a cam mechanism comprising a cam mounted on the main shaft and configured to move the printer head lever and thus the printer head into a waiting position.

8. A thermal printing mechanism according to claim 1, wherein the mechanism comprises a rotating main shaft, a cam mounted on the main shaft, an auxiliary lever having a first end configured to pivot about the pivot axis of the first end of the roll lever, a pretensioned spring connected to the roll lever and to the auxiliary lever remote from the pivot axis, the roll lever having a stop, wherein the cam is configured to act on the auxiliary lever, and wherein the pretensioned spring is configured to pull the auxiliary lever against the stop and to allow relative movement of the auxiliary lever and the roll lever to adjust the position of the counterpressure roll according to the thickness of the flat object.

9. A postage machine for printing postage on a flat object, the postage machine comprising a thermal printing mechanism according to claim 1.

* * * * *